US006139356A

United States Patent [19]

Daoud

[11] Patent Number: 6,139,356

[45] Date of Patent: Oct. 31, 2000

[54] BLOCK LABELING SYSTEM

[75] Inventor: Bassel Hage Daoud, Parsippany, N.J.

[73] Assignee: Lucent Technologies, Inc., Murray Hill, N.J.

[21] Appl. No.: 09/172,310

[22] Filed: Oct. 14, 1998

[51] Int. Cl.[7] ..... H01R 3/00

[52] U.S. Cl. ..... 439/491; 439/488

[58] Field of Search ..... 439/491, 488, 439/719, 709, 718; 200/308, 309; 174/112; 361/826; 116/200; 40/316

[56] References Cited

U.S. PATENT DOCUMENTS 3,227,886 1/1966 Dunigan et al. .

5,821,510 10/1998 Cohen et al. ..... 235/375

*Primary Examiner*—Lincoln Donovan

*Assistant Examiner*—Chandrika Prasad

*Attorney, Agent, or Firm*—Howard C. Miskin; Gloria Tsui-Yip

[57] ABSTRACT

A kit for labeling connector blocks to facilitate expansion and identification of connectors in one or more connector blocks. The kit provides modified connector blocks and a system for labeling the connector blocks. The connector block of the present invention comprises a base having spaced-apart rows of connectors and a raised pedestal corresponding to each row of connectors. A first set of pre-printed sequential numbers appear on the base identifying the leftmost connectors of each row. A second set of pre-printed sequential numbers appear on each connector across each row. In a configuration where two connector blocks are placed side-by-side, the raised pedestals of the first block advantageously overlap the first set of pre-printed numbers on the second block. Each raised pedestal further provides a surface for the application of self-adhesive labels to identify the leftmost connectors of each row on the second block. In an alternative embodiment, the pedestals has saw-tooth edges, which allow the application of a continuous strip of label across all the pedestals. The saw-tooth edges shear the strip of label simultaneously when wires are pressed against the label to be secured within troughs defined by adjacent pedestals.

12 Claims, 12 Drawing Sheets

BLOCK LABELING SYSTEM

FIELD OF THE INVENTION

The invention relates to a system for labeling connector blocks used in a building entrance protector, comprises a modified connector block and a system of labeling the connector blocks.

BACKGROUND OF THE INVENTION

A building entrance protector, i.e. junction box, provides an interface for cables from the central office of the service provider for distribution to subscribers throughout the building served by the junction box. A building entrance protector contains one or more connector blocks. Each connector block includes an array of connectors for coupling to an individual subscriber line. Typical connector blocks have either fifty or a hundred pairs of connectors. Each connector is coupled to a specific subscriber and a service technician must locate a specific connector in a connector block for servicing. Difficulty in locating a specific connector is increased where a building entrance protector services a large number of subscribers and contains more than one connector block. Without a clear identification system of each connector on each connector block, a service technician may delay servicing the proper line or the technician may service a wrong line.

One type of existing connector blocks, Lucent 110-type, provides designation strips to identify and/or numerate each of a plurality of insulation displacement connectors. A typical 110-type connector block includes two spaced-apart rows of fifty insulation displacement connectors. Each designation strip comprises a plastic jacket that latches onto the connector block along each row of connectors and a strip of paper with corresponding identification numbers for each connector that inserts into the plastic jacket. For each additional Lucent 110-type connector block that is added, two additional plastic jackets and strips of paper are required. The deficiency of the 110-type block is apparent in that upon installation of each subscriber's line, a service technician must update the strips of paper and/or provide additional plastic jackets and strips of papers, which can be a time consuming process. Furthermore, the plastic jackets often become disengaged from the connector block, causing misidentification of or inability to identity a subscriber's line.

Another type of existing connector blocks manufactured by Egerton provide pre-printed or molded numbers. A typical fifty pairs connector block of this type includes five spaced-apart rows of ten push cap connectors, each push cap connector encapsulates two insulation displacement connectors. At both ends of each row of connectors are raised pedestals, a set of five on the left side, another set of five on the right. Each pedestal has a pre-printed or molded number on the flat top surface. Troughs formed between adjacent pedestals collect and secure wires traversing between the spaced-apart rows of connectors.

The Egerton pre-molded fifty pairs connector block has numerals "1" and "10" on each end of the first row, "11" and "20" on the second row, "21" and "30" on the third row, etc. In order to locate a specific connector, for example, pair number "16", a technician starts with the row having the number "11" on the left pedestal and counts the connector until the sixth connector is reached. This can be time consuming and for a connector block having numerous wires increases the likelihood that a technician may miscount and misidentify the connectors.

Although the Egerton connector block eliminates the need to update or provide additional identification strips, it requires special order of blocks having appropriate numbers for each additional connector block added to the building entrance protector, e.g. blocks having connector pairs "51" to "100" or "101" to "150", etc. Furthermore, when a service technician visits a site, he/she needs to know ahead of time which particular connector block needs to be replaced so that he/she can have it available. These deficiencies can be overcome by having connector blocks without numbers, wherein numbers may be written on or individual self-adhesive labels be provided for the top surface of each pedestal. However, this disadvantageously becomes more time consuming.

Another disadvantage of the Egerton connector blocks becomes apparent when they are placed side-by-side with two sets of pedestals, one from each connector block, abutting each other. Wires traversing between the spaced-apart rows of connectors from one block to another must pass through two sets of troughs that are at a distance apart, which makes the placement of wires between them difficult.

Therefore, there is a need for a modified connector block and a system for labeling the connector blocks that eases identification of the connector and facilitates expansion.

SUMMARY OF THE INVENTION

The invention provides a system for labeling connector blocks, comprises a modified connector block and a system of labeling the connector blocks.

The invention provides a modified connector block having pre-printed numbers on each connector on the block and on the surface of the base along one end of each row. The pedestals advantageously overlap the base of an additional adjacent block placed side-by-side, thereby covering the inapplicable numbers on the lowered surface of the adjacent block and decreasing the distance between adjacent blocks, which facilitates wires traversing from one block to another. A system for labeling pedestals of the connector blocks is provided to quickly and accurately identify each connector on a plurality of connector blocks.

The connector block of the present invention has a plurality of connectors arranged in spaced-apart rows of ten connectors mounted on a base. On one end of the rows, on the surface of the base are pre-printed or molded numbers "1", "11", "21", etc., identifying the connectors immediately adjacent to this end. On the opposite end of the rows are raised pedestals having flat top surfaces for application of self-adhesive labels or written identification. Adjacent to or on each connector is a number between "0" and "9", with "1" being the first connector adjacent to and "0" being the tenth connector from the end of the rows where the numbers "1", "11", "21", etc. are pre-printed. The raised pedestals advantageously overlap the base of an adjacent connector block placed side-by-side and conceal the pre-printed numbers thereon. Individual self-adhesive labels are provided with the present invention for numbering the top surfaces of each pedestal and for re-numbering the numbers pre-printed on the base, if necessary.

In an alternative embodiment of the present invention, the connector block has label cutting pedestals which allows a continuous strip of label be applied across all the pedestals without having to separately apply individual labels. The top surface of each label cutting pedestal has a concave arc having jagged or saw-tooth edges. After applying a continuous strip of label across all the pedestals, it blocks the entranceway to troughs between adjacent pedestals. The saw-tooth edges shear the strip of label simultaneously when wires are pressed against the labels to enter troughs between adjacent pedestals. For this alternate embodiment, self-adhesive labels that are easy to shear is preferred.

DETAILED DESCRIPTION OF THE PREFERRED EMBODIMENTS

Figure 1:
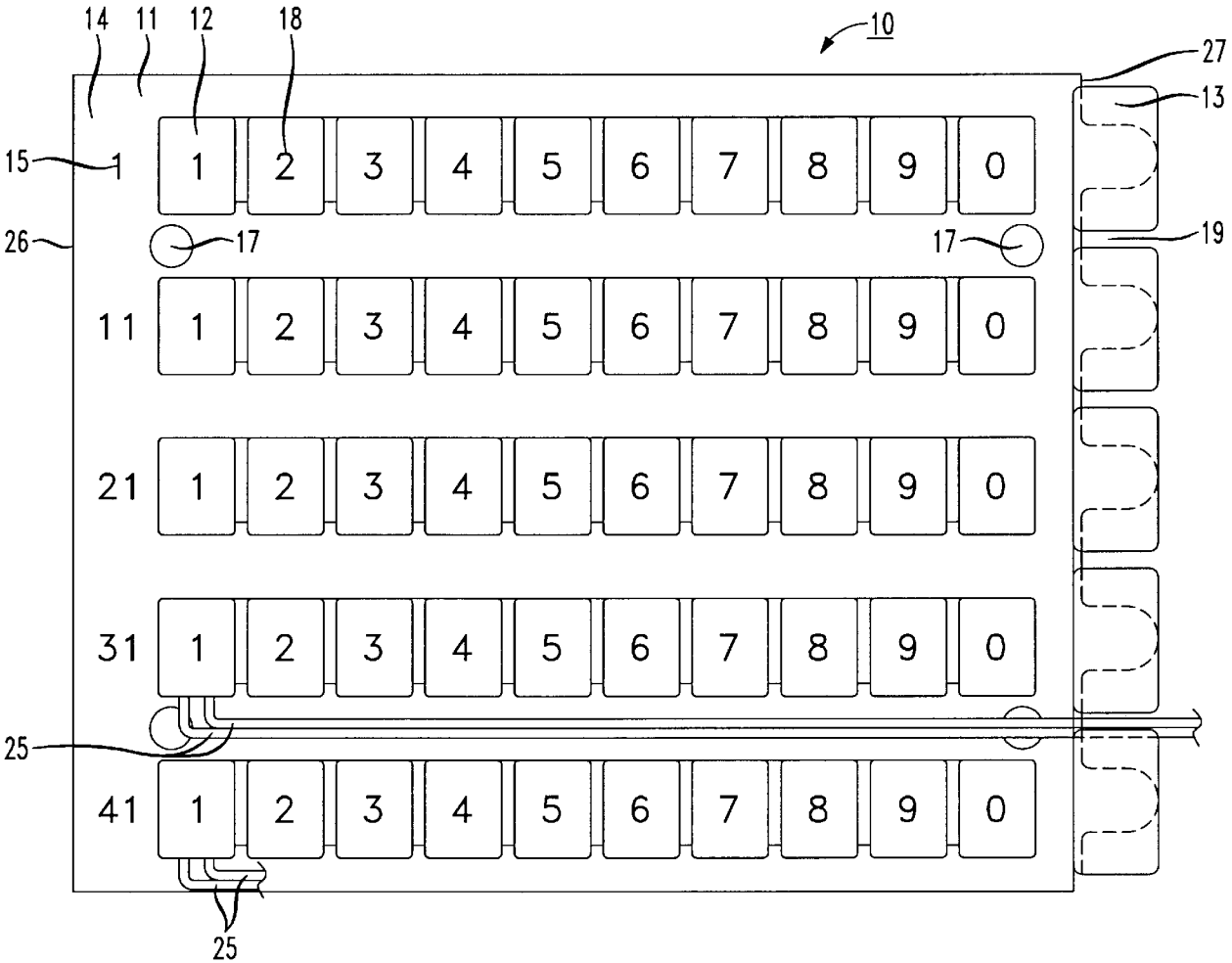
FIG. 1 is a top plan view of the present invention.

With reference to the drawings, wherein the same reference number indicates the same element throughout, there is shown in FIG. 1 a top plan view of the present invention. The present invention, connector block 10 comprises a base 11 and a plurality of connectors 12 and raised pedestals 13 upwardly extending therefrom.

As shown in FIG. 1, fifty connector pairs 12 are mounted and arranged into five spaced-apart rows of ten each on base 11. On the top surface 14 along the left side 26 of base 11 are five pre-printed or molded numbers 15, corresponding to the leftmost connector 12 of each row immediately adjacent to the pre-printed numbers 15. For the 5×10 connector block 10 shown in FIG. 1, the corresponding sequential numbers 15 are "1", "11", "21", "31" and "41". Along the right side 27 of base 11 are five raised pedestals 13, each corresponds to a row. The raised pedestals 13 have flat top surfaces 16 for application of self-adhesive labels supplied with the connector block 10 or written identification. For a single connector block 10 configuration as shown in FIG. 1, the five pedestals 13 may be marked with labels "10", "20", "30", "40" and "50" to facilitate identification of the rightmost connector 12 immediately adjacent to each raised pedestal 13 (not shown). Four holes 17 on base 11 are provided for mounting base 11 onto a building entrance protector (not shown).

As shown in FIG. 1, on each connector 12 across each row is a second set of pre-printed or molded numbers 18 between "0" and "9", with "1" being the first leftmost connector 12 adjacent to and "0" being the tenth and rightmost connector 12 from the pre-printed numbers 15. The second set of pre-printed numbers 18 may also be placed adjacent to each connector (not shown). The location of connector 12 "16" is easily identified by the row adjacent to preprinted number 15 "11" on base 11 (second row from top) and the second set of pre-printed number 18 "6" on connectors 12.

Figure 2:
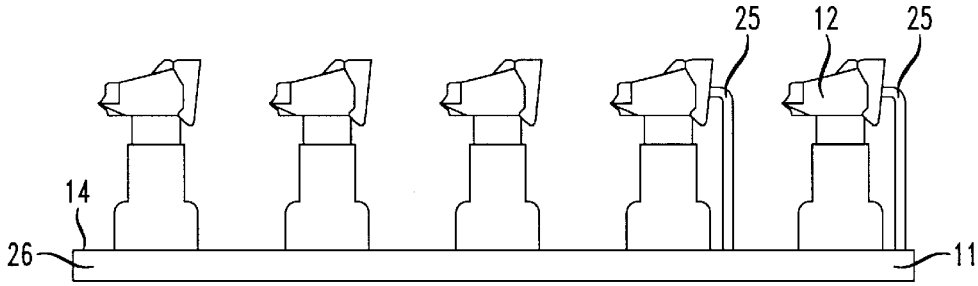
FIG. 2 is a left side view of FIG. 1, illustrating rows of spaced-apart connectors.
Figure 3:
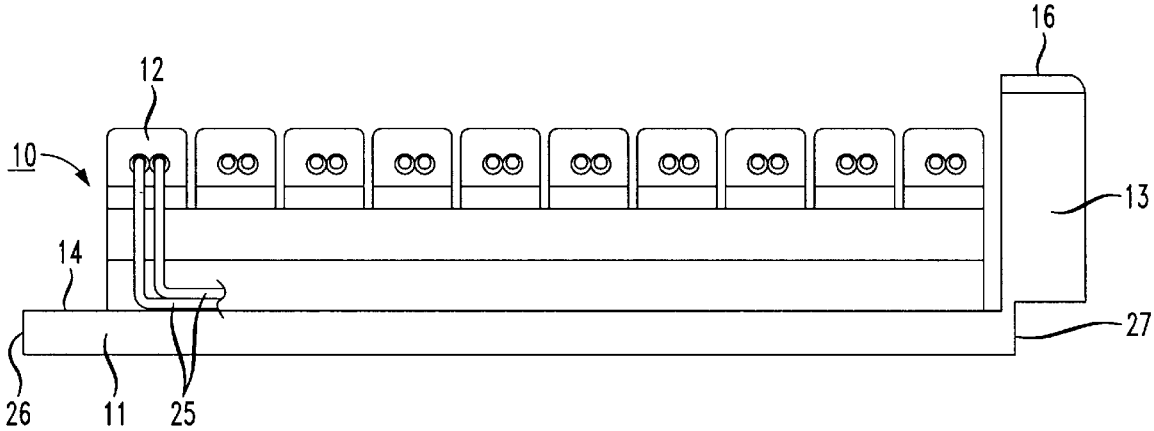
FIG. 3 is a front elevational view of FIG. 1, illustrating one row of connectors.

FIGS. 2 and 3 show the side and front views, respectively, of the five rows of ten connectors 12 mounted on base 11. Connectors 12, as shown in FIGS. 2 and 3, are of the push-cap type, wherein each connector 12 provides connection to a pair of wires 25. Other type of connectors known to one skilled in the art, such as screw-post type connectors or insulation displacement connectors, may be substituted on connector block 10 and will not deviate from the spirit of the invention.

Figure 4:
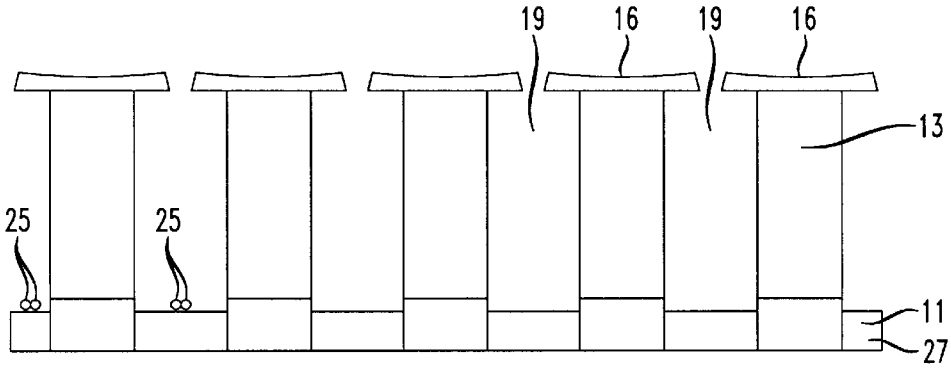
FIG. 4 is a right side view of FIG. 1, illustrating the raised pedestals and troughs defined therebetween.

As shown in FIG. 4, four troughs 19 are formed between the five raised pedestals 13 for securing and retaining wires traversing between the spaced-apart rows of connectors 12 (as shown in FIGS. 1 and 4).

Figure 5:
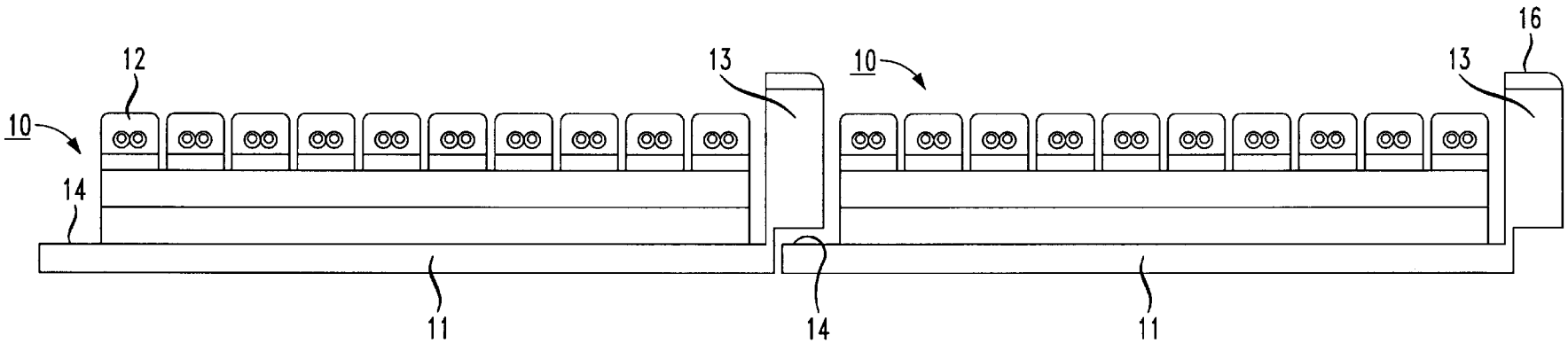
FIG. 5 is a front elevational view of two connector blocks of the present invention placed side-by-side, illustrating the raised pedestals overlapping the base of another connector block.
Figure 6:
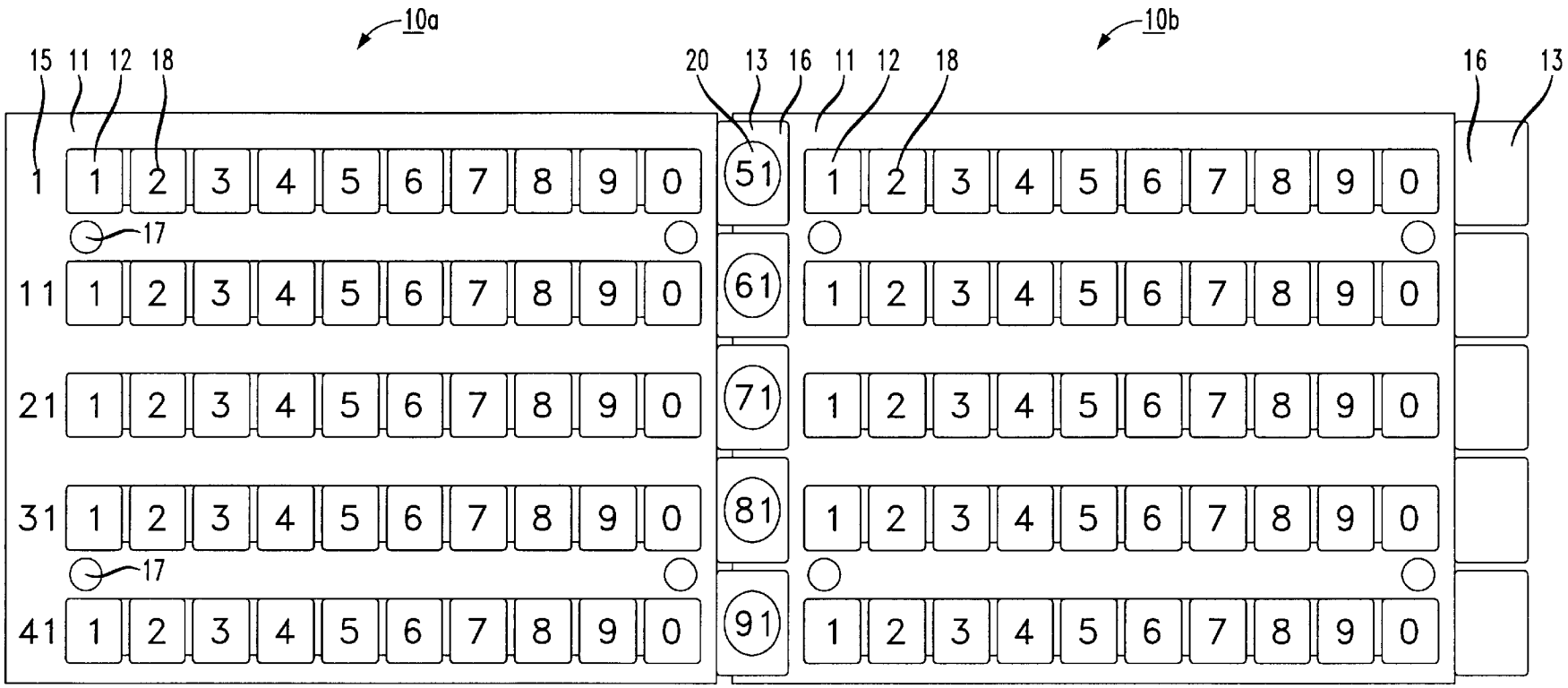
FIG. 6 is a top plan view of FIG. 5, illustrating the application of individual labels to number the raised pedestals.

FIGS. 5 to 8 illustrate two connector blocks configuration where connector blocks boa and lob are placed side-by-side. As shown in FIGS. 5 and 6, raised pedestals 13 of the first connector block 10*a* advantageously overlap and conceal the inapplicable preprinted numbers 15 on the surface 14 of base 11 of the second connector block 10*b*. The blank top surfaces 16 of pedestals 13 allow application of self-adhesive labels or written identification of numbers corresponding to the leftmost connector 12 on connector block 10*b*. The overlapped connector blocks 10*a* and 10*b* also allow the two connector blocks 10*a* and 10*b* be placed closely adjacent each other to both conserve the space provided in a building entrance protector and facilitate securing wires traversing from connector block 10*a* to connector block 10*b* through troughs 19.

Figure 7:
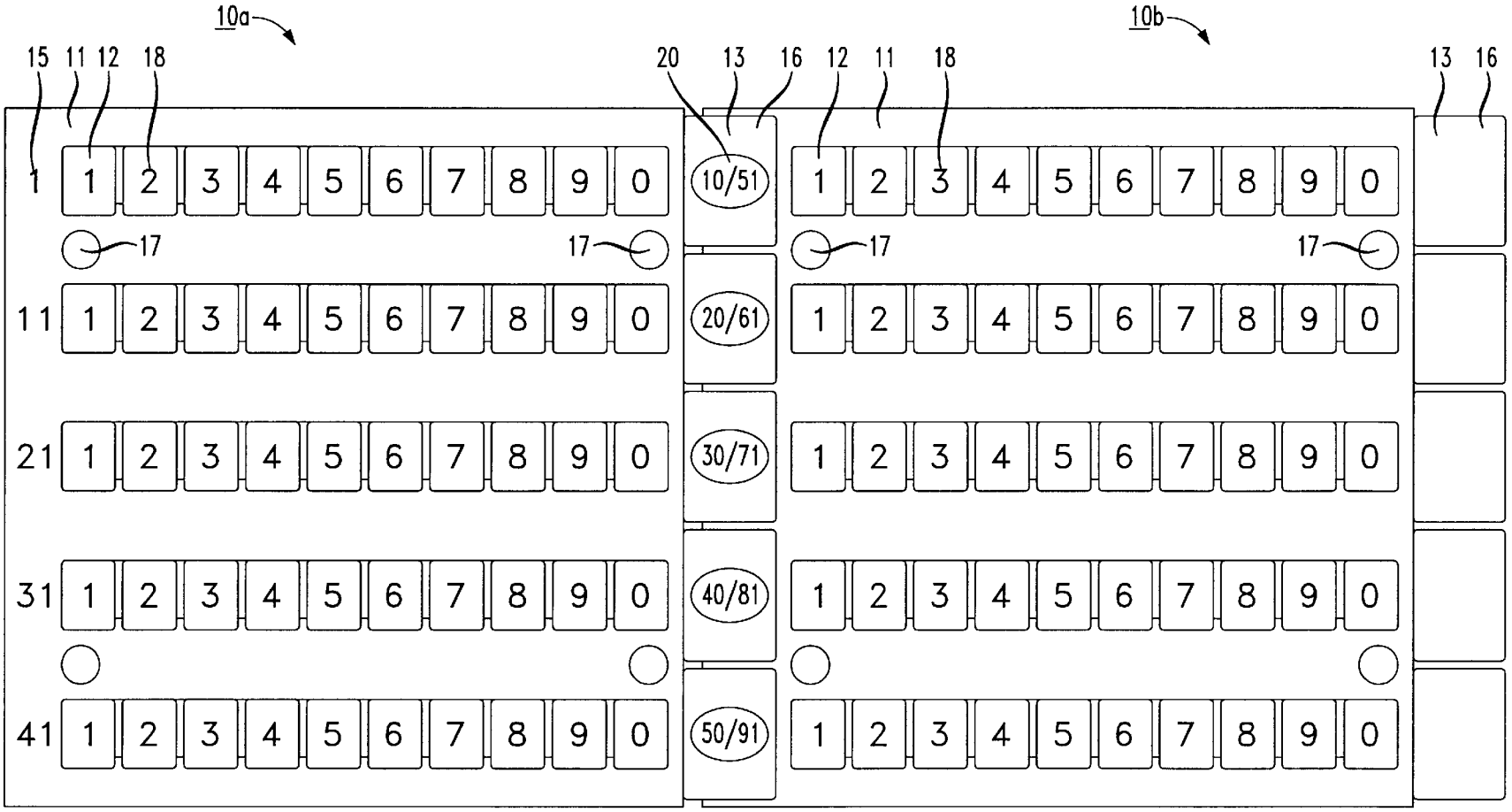
FIG. 7 is a top plan view of FIG. 5, illustrating a second alternative application of individual labels to number the raised pedestals.
Figure 8:
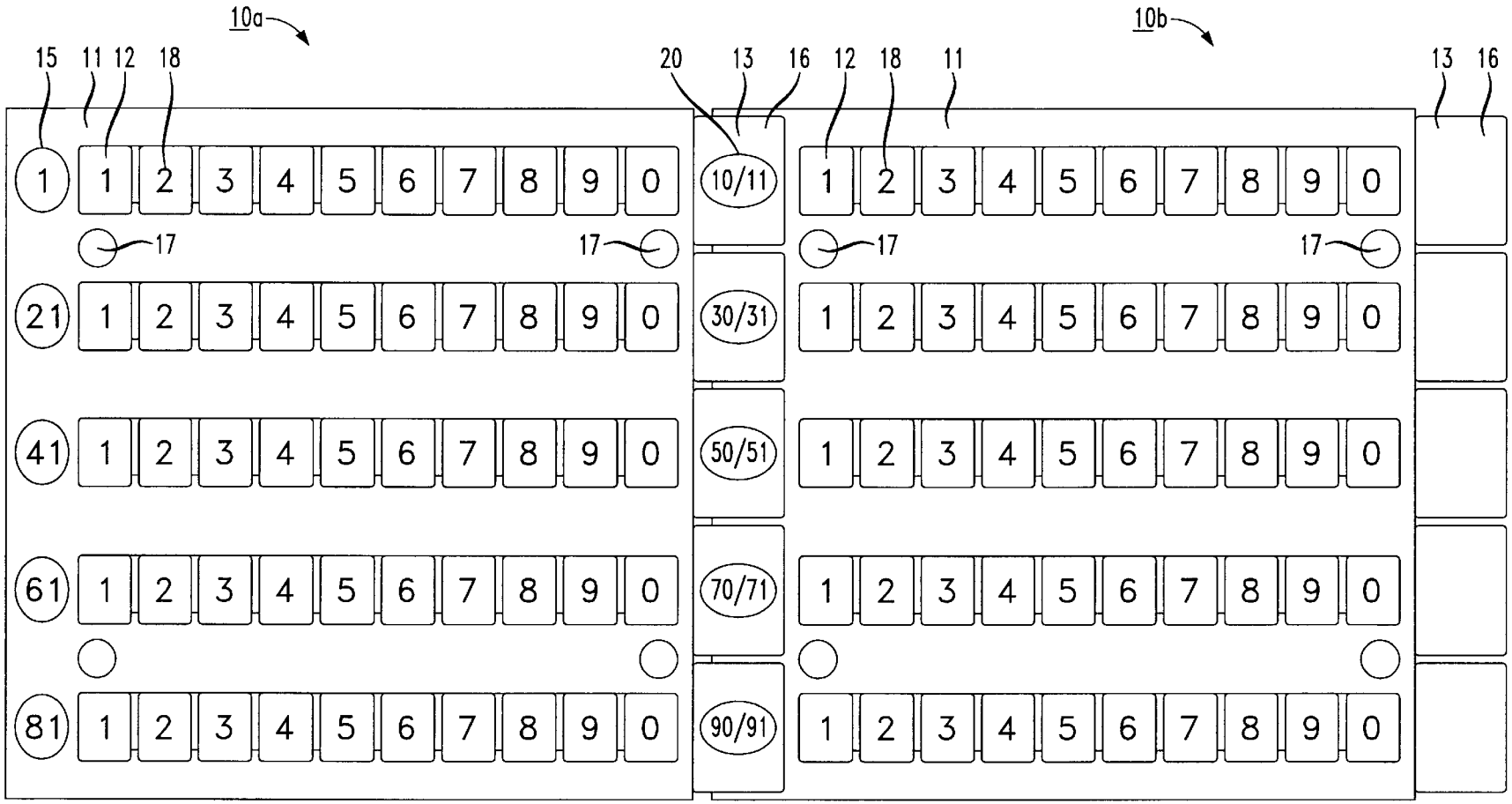
FIG. 8 is a top plan view of FIG. 5, illustrating a third alternative application of individual labels to number the raised pedestals and re-number the pre-printed numbers on the base.

For side-by-side connector blocks 10*a* and 10*b*, three different labeling methods are shown in FIGS. 6, 7 and 8. As shown in FIG. 6, individual labels 20 are provided for placement on the top surface 16 of pedestals 13 of connector block 10*a*. Labels "51", "61", "71", "81" and "91" on pedestals 13 represents connectors 12 on connector block 10*b* as connectors "51" through "100", i.e. each connector block 10*a* and 10*b* are counted one after the another. Alternatively, as shown in FIG. 7, labels 20 applied to pedestals 13 identify both the rightmost connector 12 of each row on connector block 10*a* and the leftmost connector 12 of each row on connector block 10*b*: "10/51", "20/61", "30/71", "40/81" and "50/91". For example, location of connector 12 "66" is easily identified by the row adjacent to label 20 "20/61" on pedestal 13 (second row from top of connector block 10*b*) and the second set of pre-printed numbers 18 "6" on connectors 12 of the second connector block 10*b*.

FIG. 8 shows a two connector blocks configuration wherein connectors 12 are counted across each row of both connectors boa and 10*b*. In the configuration shown in FIG. 8, labels 20 are applied both over pre-printed numbers 15 on surface 14 of base 11 and on pedestals 13 of connector block 10*a*. For example, location of connector 12 "66" is easily identified by the row adjacent to label 20 "61" on surface 14 of base 11 (fourth row from top of connector block 10*a*) and the second set of pre-printed numbers 18 "6" on connectors 12 of the first connector block 10*a*.

Figure 9:
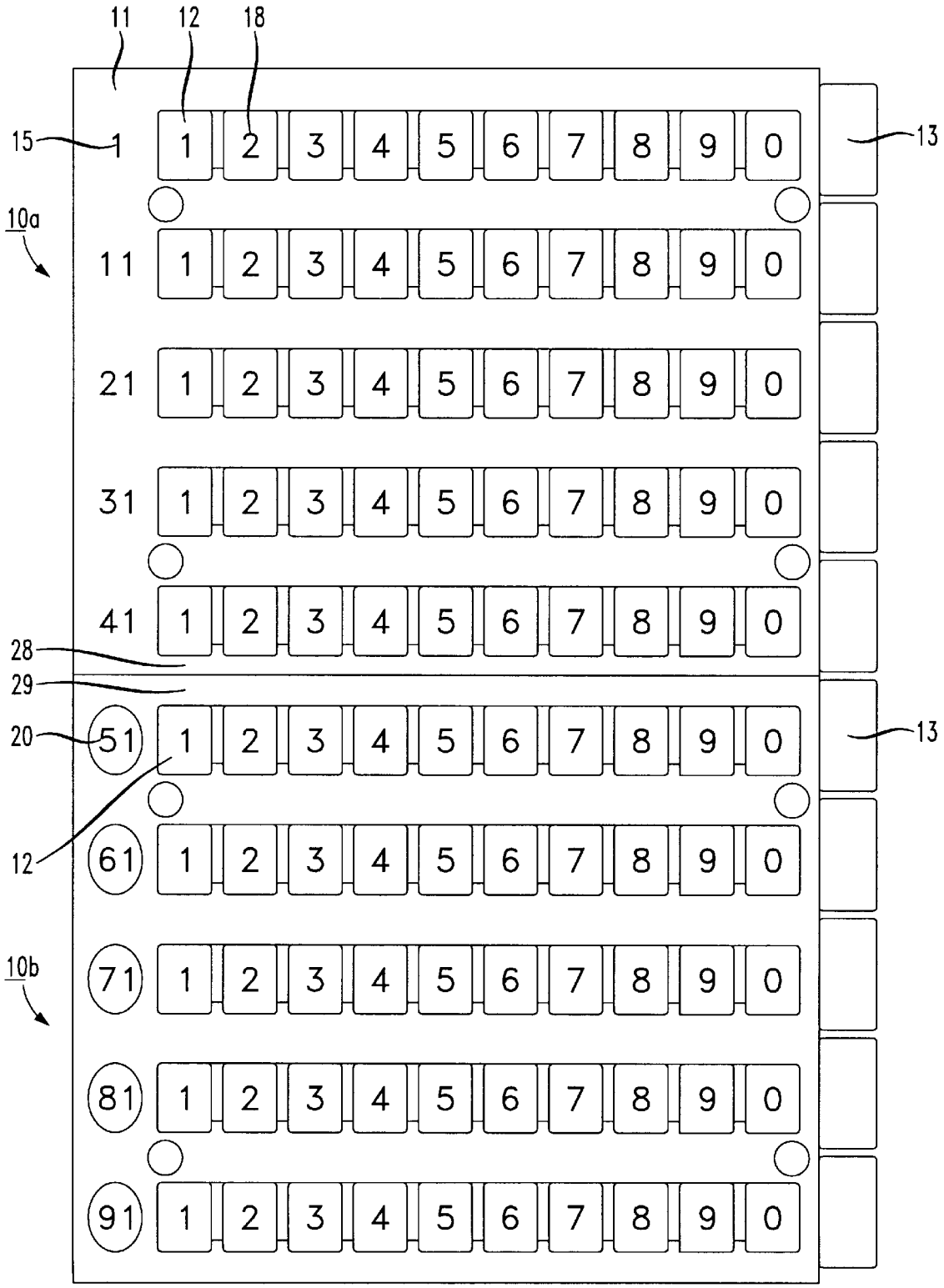
FIG. 9 is a top plan view of two connector blocks of the present invention placed front-to-back, illustrating the application of individual labels to re-number the pre-printed numbers on the base.

FIG. 9 shows two connector blocks 10*a* and 10*b* placed in a front-to-back configuration, wherein the front end 28 of connector block 10*a* abuts the rear end 29 of connector block 10*b*. Lapels 20 are applied over preprinted numbers 15 on surface 14 of base 11 of connector block 10*b*. Similar to the configuration shown in FIGS. 6 and 7, the two connector blocks configuration of FIG. 9 represents a second connector block 10*b* having connectors 12 "51" through "100".

Figure 10:
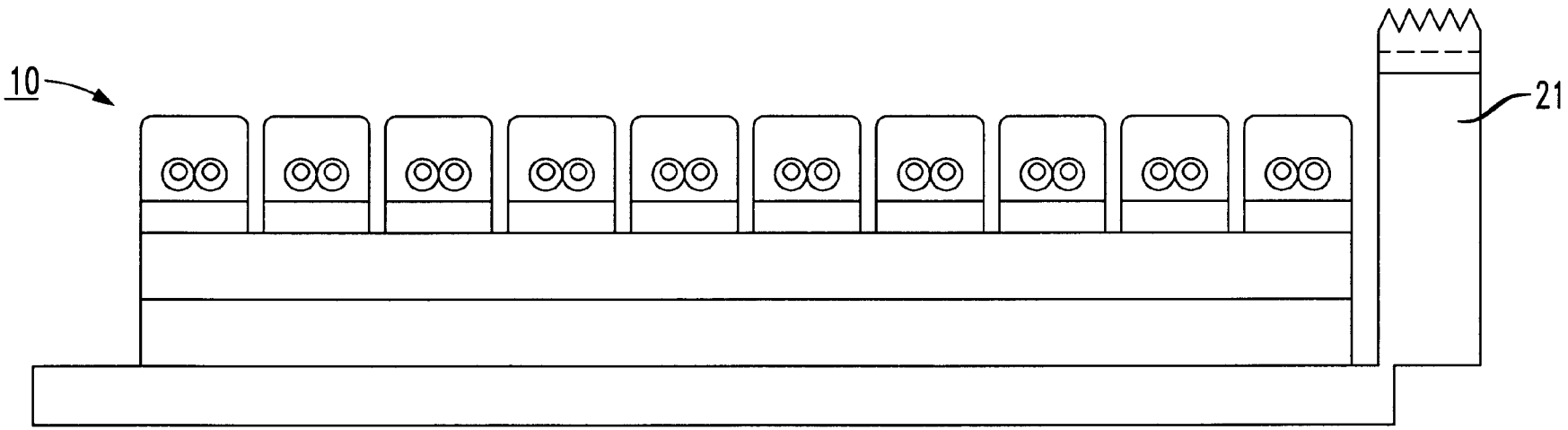
FIG. 10 is a front elevational view of a second embodiment of the present invention, with label cutting pedestals having saw-tooth edges.
Figure 11:
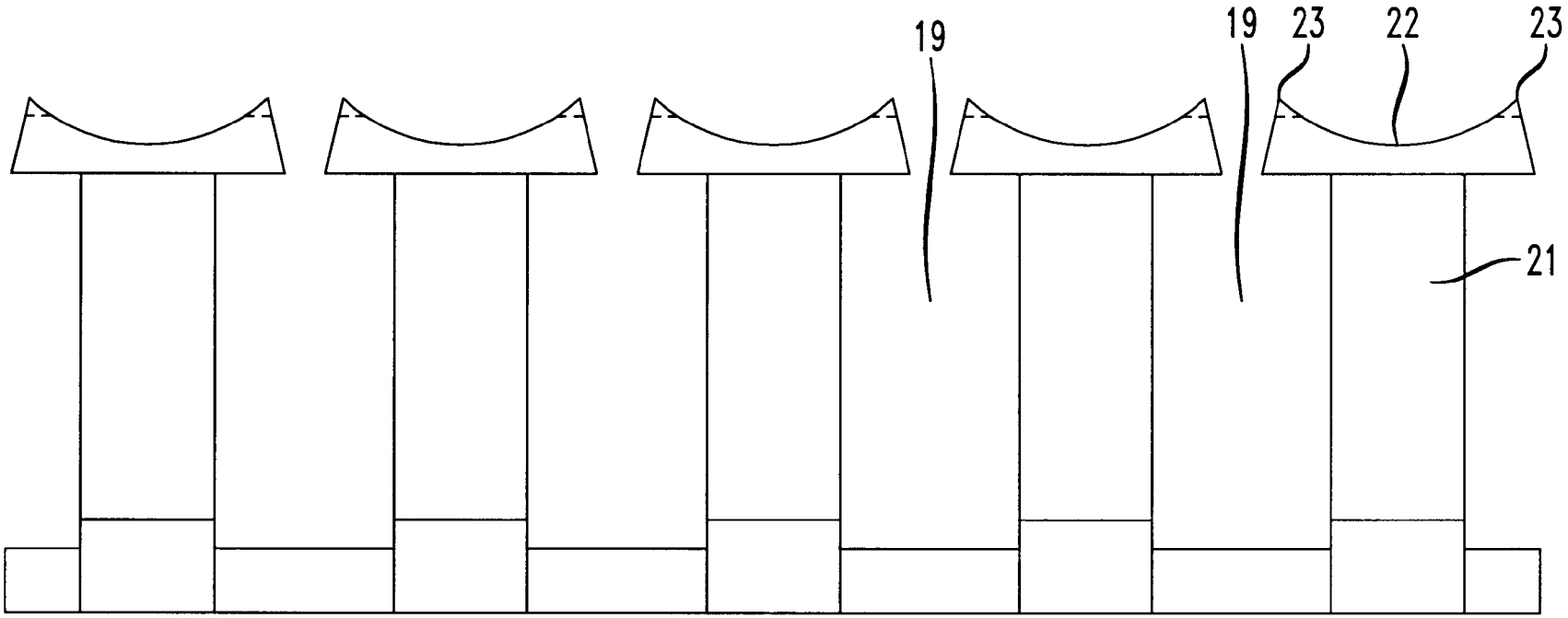
FIG. 11 is a right side view of FIG. 10, illustrating the concave arcs of the label cutting pedestals.
Figure 12:
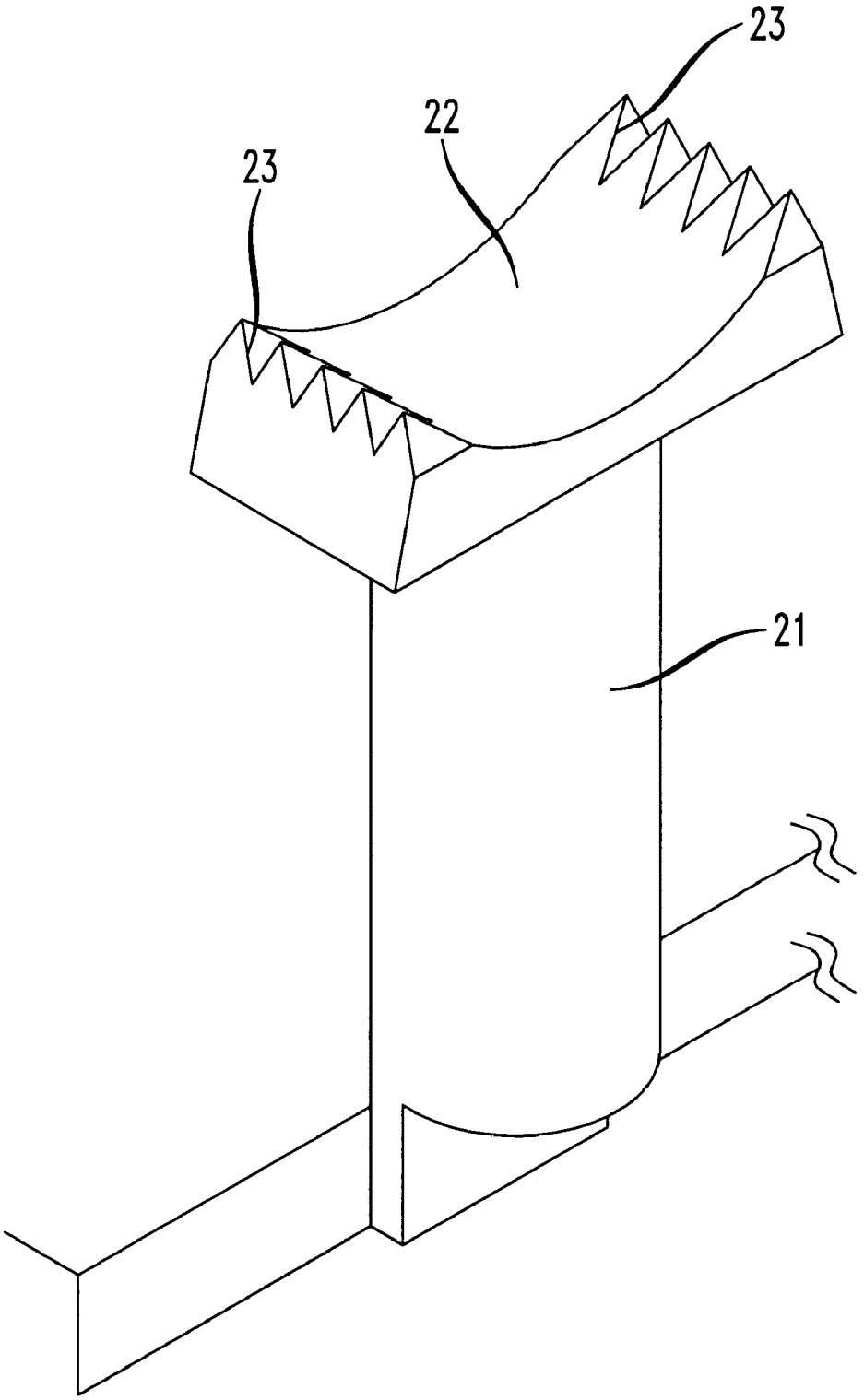
FIG. 12 is a perspective view of one label cutting pedestal.
Figure 13:
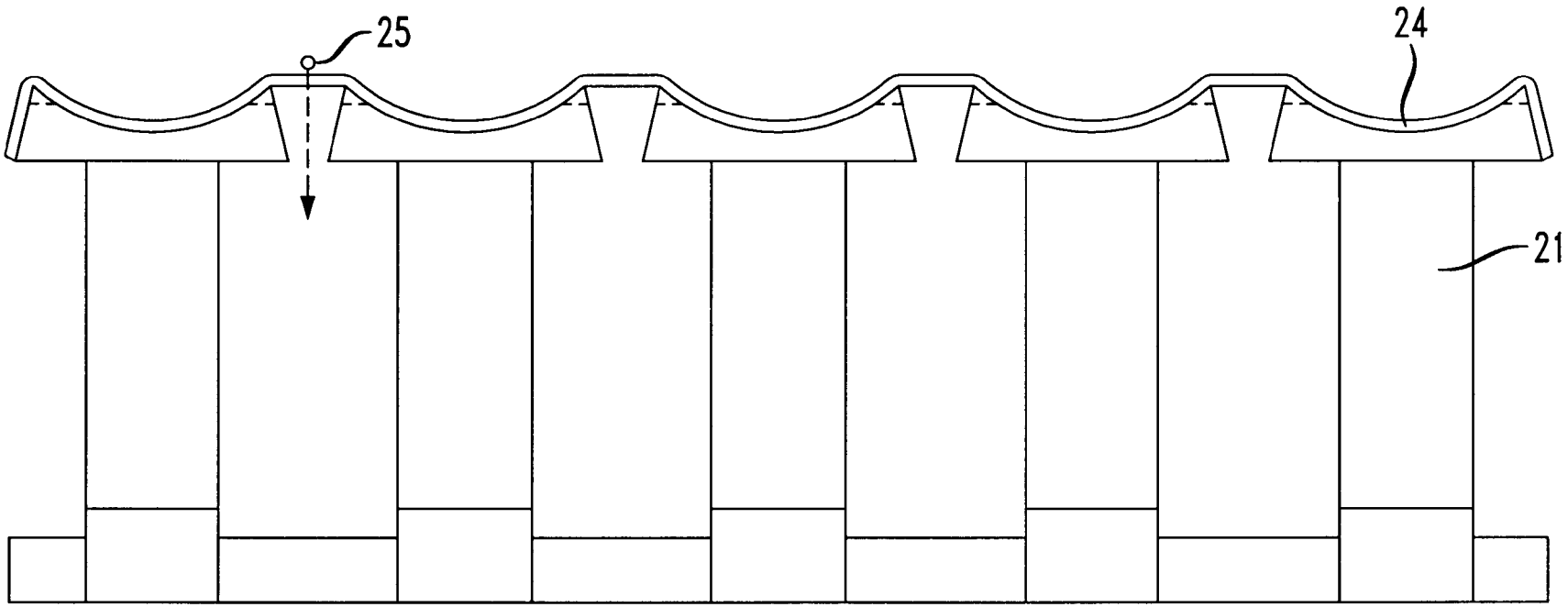
FIG. 13 is a right side view of FIG. 10, illustrating the application of a continuous strip of label across all pedestals.
Figure 14:
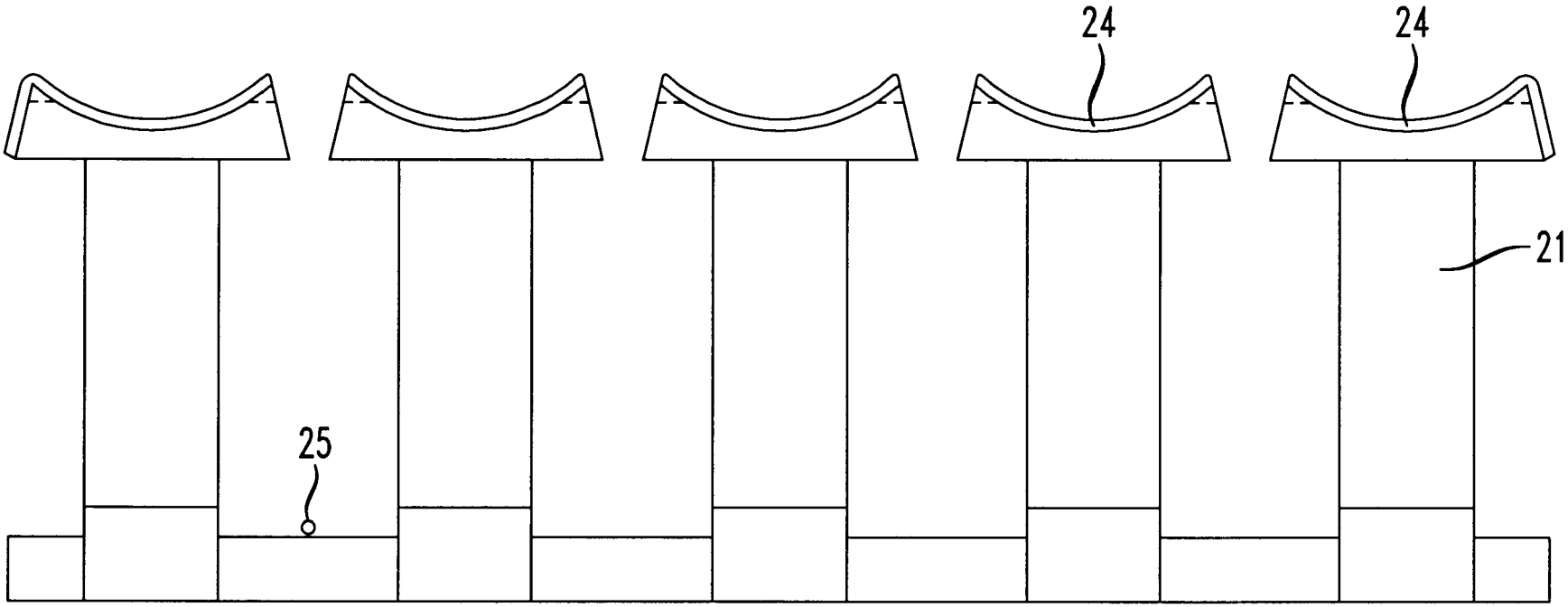
FIG. 14 is a right side view of FIG. 10, illustrating the sheared strip of label after wires are pressed against the labels to enter the troughs between adjacent pedestals.

An alternative embodiment of the present invention is shown in FIG. 10, wherein connector block 10 has a plurality of label cutting pedestals 21 that facilitate the labeling methods described in conjunction with FIGS. 6 through 9. As shown in FIGS. 10 through 12, each label cutting pedestal 21 has a concave arc surface 22 having jagged or saw-tooth edges 23. The label cutting pedestals 21 allow a continuous strip of label 24 be applied across all five pedestals 21 as shown in FIG. 13. When wires 25 are being inserted into troughs 19 to be secured, wires 25 are pressed against label 24 and simultaneously causing saw-tooth edges 23 to shear label 24 into individual ones on each pedestal 21, as shown in FIGS. 13 and 14, thereby eliminating the need to apply individual labels over each pedestal 21. For this embodiment, it is preferable that the continuous strip of label 24 be self-adhesive and easy to shear, such as paper labels with adhesive backing. Although label cutting pedestals 21 are shown to have a concave arc surface 22, surfaces of other shapes, such a rectangularized concave arc or a V-shaped arc, may be substituted and does not deviate from the spirit of the invention.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. A connector block for interfacing and facilitating identification of wires comprising:

a base having a top surface and left and right opposite sides;

a plurality of connectors upwardly extending from said top surface of said base, arranged in spaced-apart rows across from said left side to said right side, wherein each of said row of connectors having ten connectors; and a plurality of raised pedestals upwardly extending from one side of said base and corresponding to the number of and aligned with respective row of connectors, defining a plurality of troughs between adjacent pedestals for securing said wires;

said base having a first set of pre-printed sequential numbers corresponding to said connector of each row immediately adjacent to said opposite side of said base, each connector across each of said row of connectors is pre-marked with a second set of pre-printed numbers "0" through "9", with the number "1" marking the connector immediately adjacent to said opposite side of said base and the number "0" marking the connector immediately adjacent to said one side of said base;

each of said pedestals having a flat top surface for the application of individual labels corresponding to said connector of each row immediately adjacent to said one side of said base.

2. The connector block according to claim 1 wherein each of said pedestal having a concave arc surface with saw-tooth edges for the application of a continuous strip of label across said plurality of pedestals, said saw-tooth edges shear said label while wires are pressed against said label during insertion of said wires into said troughs.

3. A system for labeling connector blocks comprising:

a plurality of connector blocks for interfacing a plurality of wires, each of said connector blocks comprising:

a base having a top surface and left and right opposite sides;

a plurality of connectors upwardly extending from said top surface of said base, arranged in spaced-apart rows across from said left side to said right side; and a plurality of raised pedestals upwardly extending from said one end of said base and corresponding to the number of and aligned with respective row of connectors, defining a plurality of troughs between adjacent pedestals for securing said wires;

a plurality of labels for application on said pedestals and said top surface of said base of each connector block.

4. The kit according to claim 3 wherein each of said row of connectors having ten connectors, each of said base of said plurality of connector blocks having a first set of pre-printed sequential numbers corresponding to said connector of each row immediately adjacent to said opposite side of said base, each connector across each of said row of connectors is pre-marked with a second set of pre-printed numbers "0" through "9", with the number "1" marking the connector immediately adjacent to said opposite side of said base and the number "0" marking the connector immediately adjacent to said one side of said base.

5. The kit according to claim 4 wherein a first and second connector blocks are placed side-by-side, with said one side of said first block adjacent to said opposite side of said first block such that said raised pedestals of said first block overlap said opposite side left of said base of said second block to cover said first set of pre-printed sequential numbers on said second block.

6. The kit according to claim 5 wherein each of said pedestal of said plurality of connector blocks having a flat top surface for application of said labels corresponding to said connector of each row immediately adjacent to said one side of said base of each connector block.

7. The kit according to claim 6 wherein said labels corresponding to the sequential number of said connectors of each row on said second block immediately adjacent to said pedestal of said first connector block is individually applied to each of said flat top surface of each of said pedestal of said first connector block.

8. The kit according to claim 5 wherein each of said pedestal of said plurality of connector blocks having a concave arc surface with saw-tooth edges for the application of a continuous strip of label across said plurality of pedestals, said saw-tooth edges shear said label while wires are pressed against said label during insertion of said wires into said troughs.

9. The kit according to claim 8 wherein said continuous strip of label corresponding to the sequential numbers of said connectors of each row on said second block immediately adjacent to said pedestal of said first connector block is applied across said concave arc surfaces of said pedestals of said first connector block.

10. The kit according to claim 3 wherein said labels are self-adhesive and made of paper.

11. The kit according to claim 4 wherein said base of each of said connector block further having a front end and a back end, a first and second connector blocks are placed front-to-back, with the front end of said first block adjacent to said back end of said first block, said labels corresponding to the sequential number of said connectors of each row on said second block immediately adjacent to said opposite end of said second connector block is applied over said first set of pre-printed sequential numbers on said surface of said base of said second connector block.

12. A connector block for interfacing and facilitating identification of wires comprising:

a base having a top surface and left and right opposite sides;

a plurality of connectors upwardly extending from said top surface of said base, arranged in spaced-apart rows across from said left side to said right side, wherein each of said row of connectors having ten connectors; and a plurality of raised pedestals upwardly extending from said one side of said base and corresponding to the number of and aligned with respective row of connectors, defining a plurality of troughs between adjacent pedestals for securing said wires;

said base having a first set of pre-printed sequential numbers corresponding to said connector of each row immediately adjacent to said opposite side of said base, each connector across each of said row of connectors is pre-marked with a second set of pre-printed numbers "0" through "9", with the number "1" marking the connector immediately adjacent to said opposite side of said base and the number "0" marking the connector immediately adjacent to said one side of said base;

each of said pedestals having a flat top surface for written identification corresponding to said connector of each row immediately adjacent to said one side of said base.

* * * * *